US007123727B2

(12) United States Patent
Elko et al.

(10) Patent No.: US 7,123,727 B2
(45) Date of Patent: Oct. 17, 2006

(54) ADAPTIVE CLOSE-TALKING DIFFERENTIAL MICROPHONE ARRAY

(75) Inventors: Gary W. Elko, Summit, NJ (US); Heinz Teutsch, Nurnberg (DE)

(73) Assignee: Agere Systems Inc., Allentown, PA (US)

( * ) Notice: Subject to any disclaimer, the term of this patent is extended or adjusted under 35 U.S.C. 154(b) by 893 days.

(21) Appl. No.: 09/999,380

(22) Filed: Oct. 30, 2001

(65) Prior Publication Data

US 2003/0016835 A1 Jan. 23, 2003

Related U.S. Application Data

(60) Provisional application No. 60/306,271, filed on Jul. 18, 2001.

(51) Int. Cl.
*H04R 3/00* (2006.01)

(52) U.S. Cl. ..... 381/92

(58) Field of Classification Search ..... 381/92, 381/313

See application file for complete search history.

(56) References Cited

U.S. PATENT DOCUMENTS

| | | | | |
|---|---|---|---|---|
| 4,006,310 | A | 2/1977 | Bayer | 179/1 H |
| 5,473,701 | A | 12/1995 | Cezanne et al. | 381/92 |
| 5,586,191 | A | 12/1996 | Elko et al. | 381/92 |
| 5,633,935 | A | 5/1997 | Kanamori et al. | 381/26 |
| 5,737,431 | A * | 4/1998 | Brandstein et al. | 381/92 |
| 5,740,256 | A | 4/1998 | Castello Da Costa et al. | 361/94.7 |
| 6,009,396 | A * | 12/1999 | Nagata | 381/92 |
| 6,385,323 | B1 * | 5/2002 | Zoels | 381/313 |
| 6,549,630 | B1 * | 4/2003 | Bobisuthi | 381/94.7 |
| 6,600,824 | B1 * | 7/2003 | Matsuo | 381/92 |
| 2002/0181720 | A1 * | 12/2002 | Maisano | 381/92 |

* cited by examiner

*Primary Examiner*—Brian T. Pendleton

(57) ABSTRACT

A method and apparatus for providing a differential microphone with a desired frequency response are disclosed. The desired frequency response is provided by operation of a filter, having an adjustable frequency response, coupled to the microphone. The frequency response of the filter is set by operation of a controller, also coupled to the microphone, based on signals received from the microphone. The desired frequency response may be determined based upon the orientation angle and the distance between the microphone and a source of sound. The frequency response of the filter may comprise the substantial inverse of the frequency response of the microphone to provide a flat response. In a preferred embodiment, the gain of the differential microphone is adjusted so that the output level is effectively independent of microphone position relative to the source. In particular embodiments, the controller may determine, based on the distance from the sound source, whether to operate the differential microphone in a nearfield mode of operation or a farfield mode of operation.

42 Claims, 14 Drawing Sheets

RESPONSE (dB)
10
5
0
-5
-10
-15
-20
-25
-30
-35
-40
r=17mm
r=21mm
r=39mm
r=51mm
r=75mm
$10^2$
$10^3$
$10^4$
FREQUENCY (Hz)

ADAPTIVE CLOSE-TALKING DIFFERENTIAL MICROPHONE ARRAY

CROSS-REFERENCE TO RELATED APPLICATIONS

This application claims the benefit of the filing date of U.S. provisional application No. 60/306,271, filed on Jul. 18, 2001.

BACKGROUND OF THE INVENTION

1. Field of the Invention

The present invention relates to audio processing, and, in particular, to adjusting the frequency response of microphone arrays to provide a desired response.

2. Description of the Related Art

Speech signal acquisition in noisy environments is a challenging problem. For applications like speech recognition, teleconferencing, or hands-free human-machine interfacing, high signal-to-noise ratio at the microphone output is a prerequisite in order to obtain acceptable results from any algorithm trying to extract a speech signal from noise-contaminated signals. Because of possibly changing acoustical environments and varying position of the talker with respect to the microphone, conventional fixed directional microphones (i.e., dipole or cardioid elements) are often not able to deliver sufficient performance in terms of signal-to-noise ratio. For that reason, work has been done in the field of electronically steerable microphone arrays operating under farfield conditions (see, e.g., Flanagan, J. L., Berkley, D. A., Elko, G. W., West, J. E., and Sondhi, M. M., "Autodirective microphone systems," Acoustica, vol. 73, pp. 58–71, 1991, and Kellermann, W., "A self-steering digital microphone array," IEEE International Conference on Acoustics, Speech and Signal Processing (ICASSP), Toronto, Canada, 1991), i.e., where the distance between a signal source and an array is much greater than the geometric dimensions of the array.

However, under extreme acoustical environments, which can be found, for example, in a cockpit of an airplane, only close-talking microphones (nearfield operation) can be used to ensure satisfactory communication conditions. A way of exceeding the performance of conventional microphone technology used for close-talking applications is to use close-talking differential microphone arrays (CTMAs) that inherently provide farfield noise attenuation. If the CTMA is positioned appropriately, the signal-to-noise ratio gain for the CTMA will be inversely proportional to frequency to the power of the number of zero-order (omnidirectional) elements in the array minus one. One issue of using differential microphones in close-talking applications is that they have to be placed as close to the mouth as possible to exploit the nearfield properties of the acoustic field. However, the frequency response and output level of a CTMA depend heavily on the position of the array relative to the talker's mouth. As the array is moved away from the mouth, the output signal becomes progressively highpassed and significantly lower in level. In practice, people using close-talking microphones tend to use them at suboptimal positions, e.g., far away from the mouth. This will degrade the performance of a CTMA.

SUMMARY OF THE INVENTION

Embodiments of the present invention are directed to techniques that enable exploitation of the advantages of close-talking differential microphone arrays (CTMAs) for an extended range of microphone positions by tracking the desired signal source by estimating its distance and orientation angle. With this information, appropriate correction filters can be applied adaptively to equalize unwanted frequency response and level deviations within a reasonable range of operation without significantly degrading the noise-canceling properties of differential arrays.

In one embodiment, the present invention is a method for providing a differential microphone with a desired frequency response, the differential microphone coupled to a filter having a frequency response which is adjustable, the method comprising the steps of (a) determining an orientation angle between the differential microphone and a desired source of signal; (b) determining a distance between the differential microphone and the desired source of signal; (c) determining a filter frequency response, based on the determined distance and orientation angle, to provide the differential microphone with the desired frequency response to sound from the desired source; and (d) adjusting the filter to exhibit the determined frequency response.

In another embodiment, the present invention is an apparatus for providing a differential microphone with a desired frequency response, the apparatus comprising (a) an adjustable filter, coupled to the differential microphone; and (b) a controller, coupled to the differential microphone and the filter and configured to (1) determine a distance and an orientation angle between the differential microphone and a desired source of sound and (2) adjust the filter to provide the differential microphone with the desired frequency response based on the determined distance and orientation angle.

In yet another embodiment, the present invention is a method for operating a differential microphone comprising the steps of (a) determining a distance between the differential microphone and a desired source of signal; (b) comparing the determined distance to a specified threshold distance; (c) determining whether to operate the differential microphone in a nearfield mode of operation or a farfield mode of operation based on the comparison of step (b); and (d) operating the differential microphone in the determined mode of operation.

In still another embodiment, the present invention is an apparatus for operating a differential microphone, the apparatus comprising a controller, configured to be coupled to the differential microphone and to (1) determine a distance between the differential microphone and a desired source of signal; (2) compare the determined distance to a specified threshold distance; (3) determine whether to operate the differential microphone in a nearfield mode of operation or a farfield mode of operation based on the comparison; and (4) operate the differential microphone in the determined mode of operation.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

According to embodiments of the present invention, corrections are made for situations where a close-talking differential microphone array (CTMA) is not positioned ideally with respect to the talker's mouth. This is accomplished by estimating the distance and angular orientation of the array relative to the talker's mouth. By adaptively applying a correction filter and gain for a first-order CTMA consisting of two omnidirectional elements, a nominally flat frequency response and uniform level can be obtained for a reasonable range of operation without significantly degrading the noise canceling properties of CTMAs. This specification also addresses the effect of microphone element sensitivity mismatch on CTMA performance. A simple technique for microphone calibration is presented. In order to be able to demonstrate the capabilities of the adaptive CTMA without relying on special-purpose hardware, a real-time implementation was programmed on a standard personal computer under the Microsoft® Windows® operating system.

Adaptive First-Order CTMA

Figure 1:
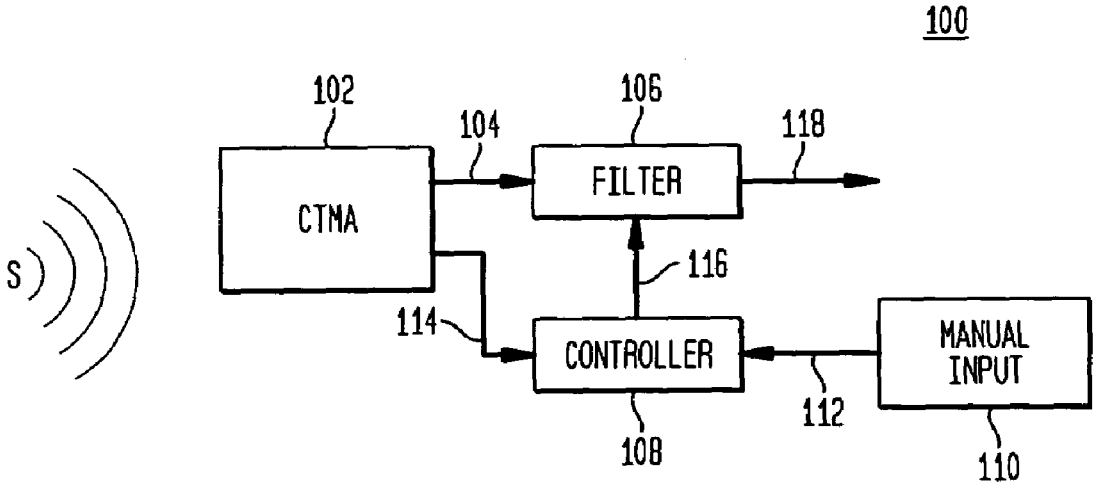
FIG. 1 shows a block diagram of an audio processing system, according to one embodiment of the present invention.

FIG. 1 shows a block diagram of an audio processing system 100, according to one embodiment of the present invention. In system 100, a CTMA 102 of order n provides an output 104 to a filter 106. Filter 106 is adjustable (i.e., selectable or tunable) during microphone use. A controller 108 is provided to automatically adjust the filter frequency response. Controller 108 can also be operated by manual input 110 via a control signal 112.

In operation, controller 108 receives from CTMA 102 signal 114, which is used to determine the operating distance and angle between CTMA 102 and the source S of sound. Operating distance and angle may be determined once (e.g., as an initialization procedure) or multiple times (e.g., periodically) to track a moving source. Based on the determined distance and angle, controller 108 provides control signals 116 to filter 106 to adjust the filter to the desired filter frequency response. Filter 106 filters signal 104 received from CTMA 102 to generate filtered output signal 118, which is provided to subsequent stages for further processing. Signal 114 is preferably a (e.g., low-pass) filtered version of signal 104. This can help with distance estimations that are based on broadband signals.

Frequency Response and Gain Equalization

One illustrative embodiment of the present invention involves pressure differential microphones (PDMs). In general, the frequence response of a PDM of order n ("PDM (n)") is given in terms of the nth derivative of acoustic pressure, $p=P_o e^{-jkr}/r$, within a sound field of a point source, with respect to operating distance, where $P_o$ is source peak amplitude, k is the acoustic wave number ($k=2\pi/\lambda$, where λ is wavelength and $\lambda=c/f$, where c is the speed of sound and f is frequency in Hz), and r is the operating distance. The ordinary artisan will understand that the present invention can be implemented using differential microphones other than PDMs, such as velocity and displacement differential microphones, as well as cardioid microphones.

Figure 2:
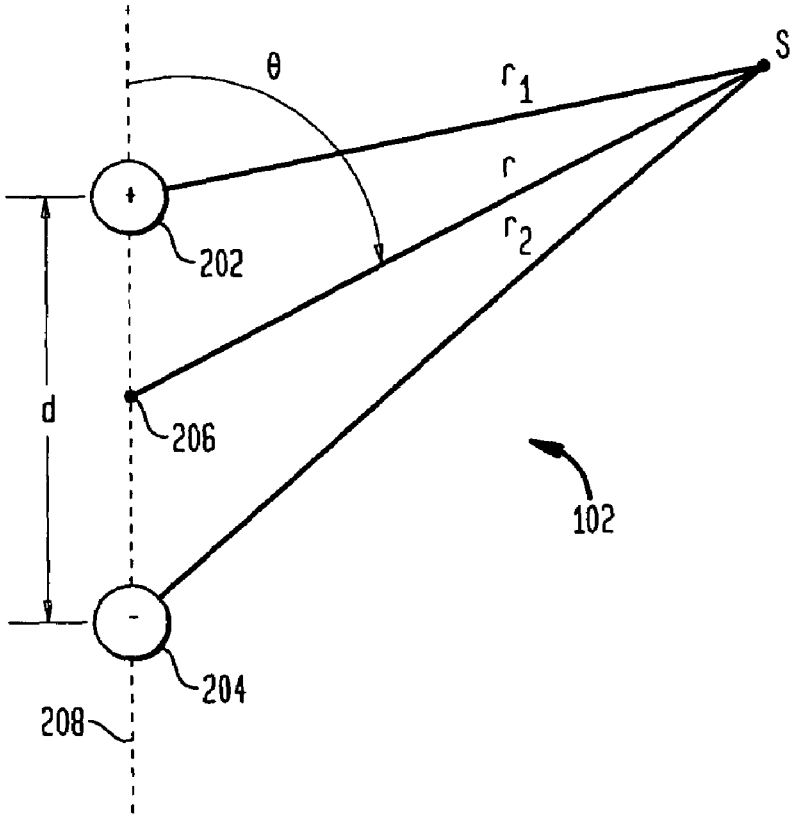
FIG. 2 shows a schematic representation of the close-talking differential microphone array (CTMA) in relation to a source of sound, where the CTMA is implemented as a first-order pressure differential microphone (PDM)

FIG. 2 shows a schematic representation of CTMA 102 of FIG. 1 in relation to a source S of sound, where CTMA 102 is implemented as a first-order PDM. In this case, CTMA 102 typically includes two sensing elements: a first sensing element 202, which responds to incident acoustic pressure from source S by producing a first response, and a second sensing element 204, which responds to incident acoustic pressure by producing a second response. First and second sensing elements 202 and 204 may be, for example, two ("zeroth"-order) pressure microphones. The sensing elements are separated by an effective acoustic difference d, such that each sensing element is located a distance d/2 from the effective acoustic center 206 of CTMA 102. The point source S is shown to be at an operating distance r from the effective acoustic center 206, with first and second sensing elements located at distances $r_1$ and $r_2$, respectively, from source S. An angle θ exists between the direction of sound propagation from source S and microphone axis 208.

The first-order response of two closely-spaced zeroth-order elements (i.e., the difference between the signals from the two elements), such as elements 202 and 204 as shown in FIG. 2, can be written according to Equation (1) as follows:

$$V(r,\theta;f)=\frac{e^{-jkr_1}}{r_1}-\frac{e^{-jkr_2}}{r_2}, \tag{1}$$

where $k=2\pi/\lambda=2\lambda f/c$ is the wave number with propagation velocity c and wavelength λ.

Figure 3:
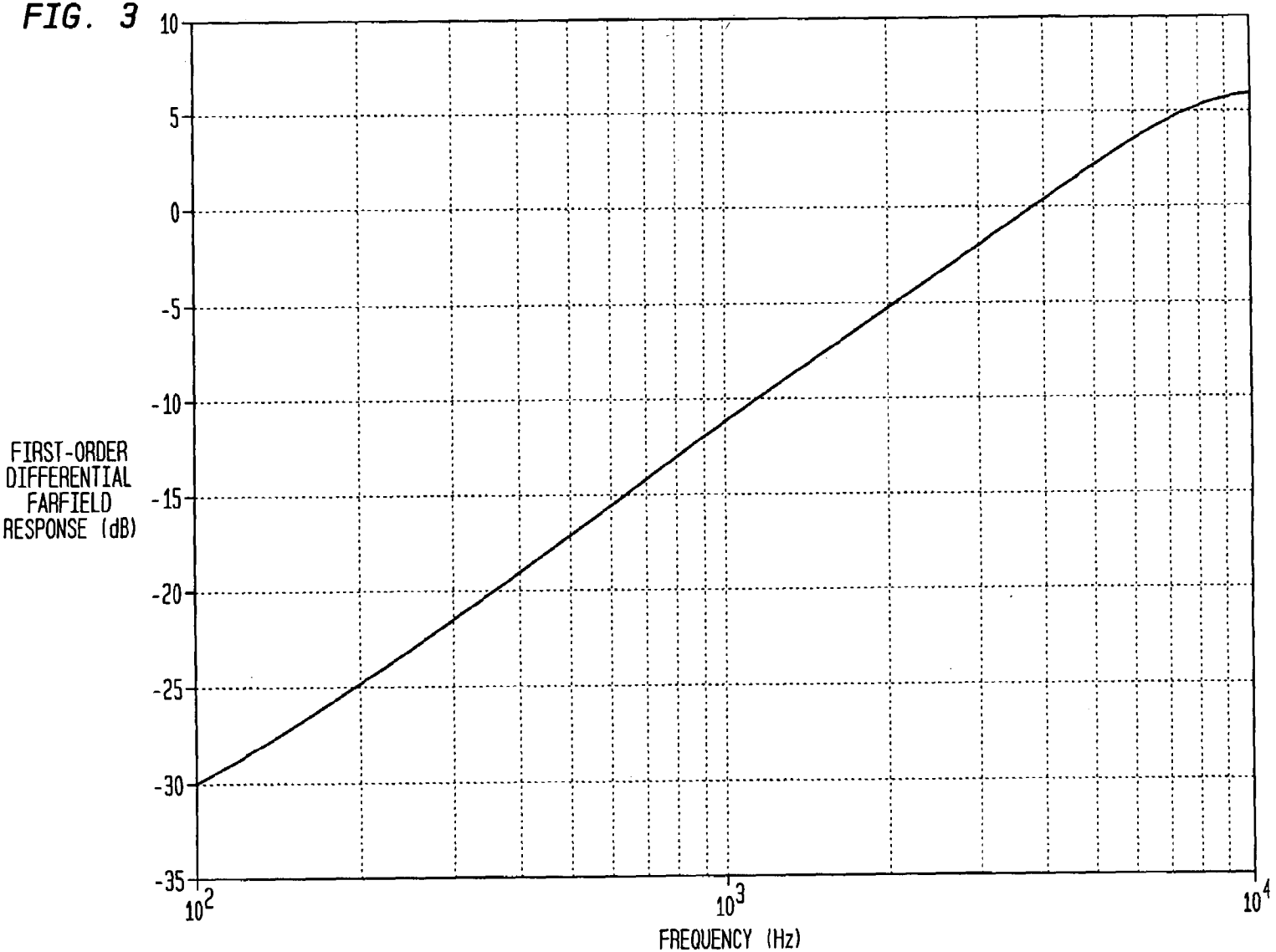
FIG. 3 shows a graphical representation of the farfield response of the first-order CTMA of FIG. 2 for d=1.5 cm.

FIG. 3 shows the farfield response of first-order CTMA 102 of FIGS. 1 and 2 for d=1.5 cm and r=1 m, which stresses the natural superiority of the differential system compared to an omnidirectional transducer, because of the farfield low-frequency noise attenuation (6 dB/octave). The validity of the farfield assumption depends on the wavelength of the incoming wavefront in relation to the dimensions of the array. For the particular example of FIG. 3, the farfield assumption applies for r=1 m.

Figure 4:
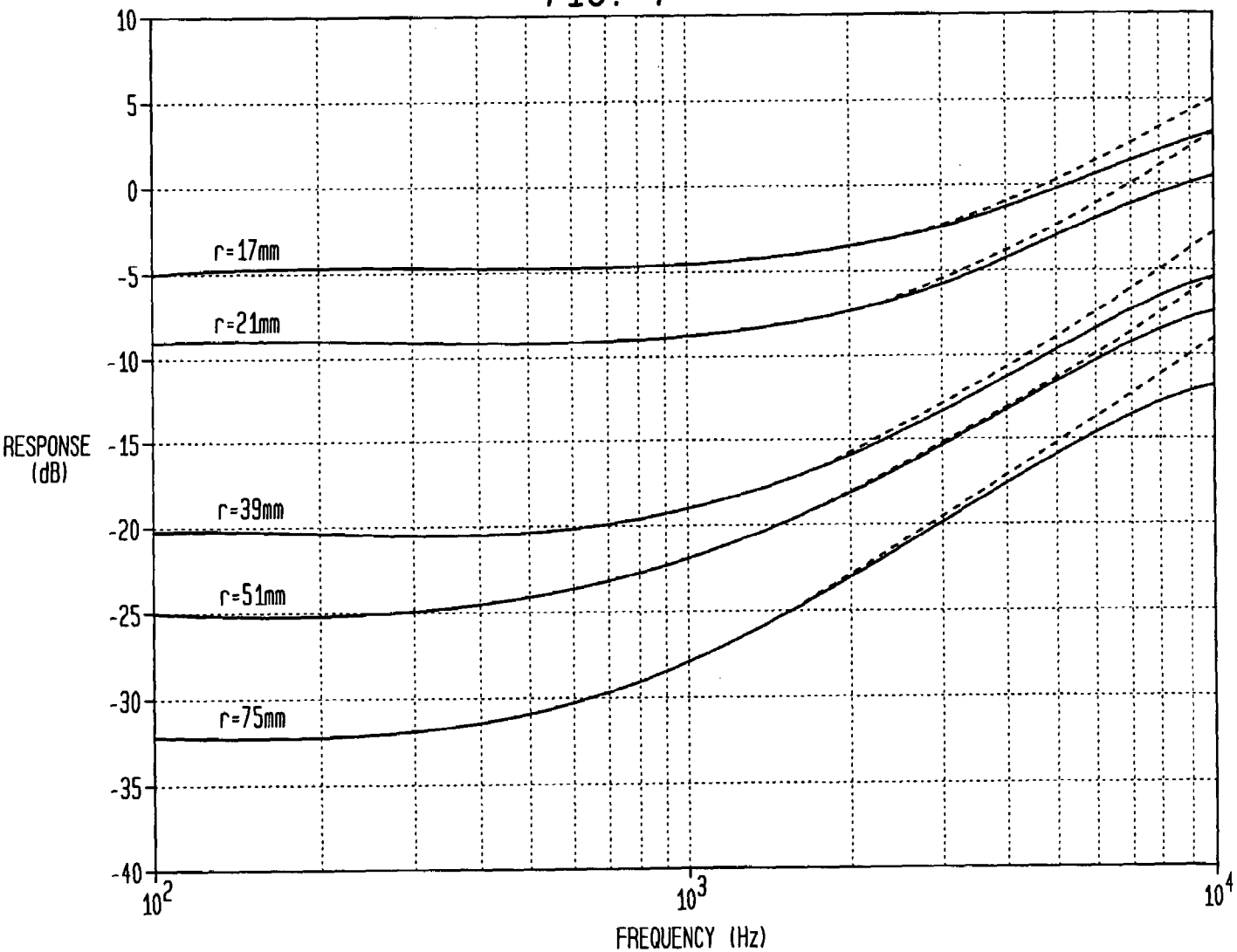
FIG. 4 shows a graphical representation of the nearfield responses of the first-order CTMA of FIG. 2 for d=1.5 cm and θ=20°.
Figure 5:
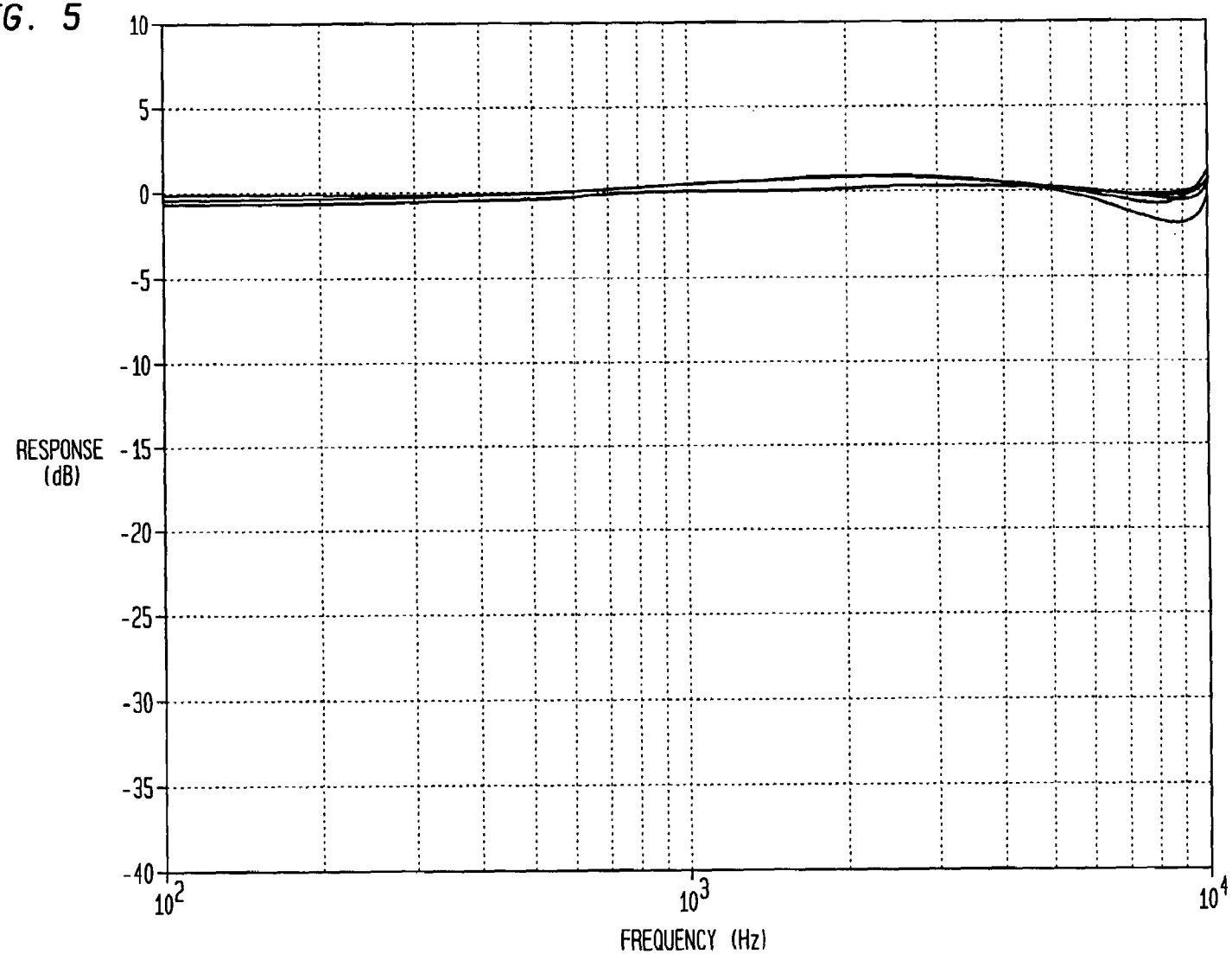
FIG. 5 shows a graphical representation of the corrected responses corresponding to the nearfield responses of FIG. 4 for d=1.5 cm and θ=20°.

FIG. 4 shows nearfield responses of a first-order CTMA, such as CTMA 102 of FIGS. 1 and 2, for a few selected distances r of the array's center to the point source S for d=1.5 cm and θ=20°. This figure shows that correction filters should be used if a CTMA is to be used at positions other than the optimum position, which is right at the talker's mouth. FIG. 5 shows corrected responses corresponding to the nearfield responses of FIG. 4.

For situations in which (kd<1), Equation (1) can be approximated by Equation (2) as follows:

$$V(r,\theta;f)\approx\left[\frac{r_2-r_1}{r_1r_2}\left(1+jkr-\frac{k^2r^2}{2}\right)-\frac{r_1-r_2}{2}k^2\right]\cdot e^{-jkr}, \tag{2}$$

whose response is also shown in FIG. 4 in the form of dashed curves.

Figure 6:
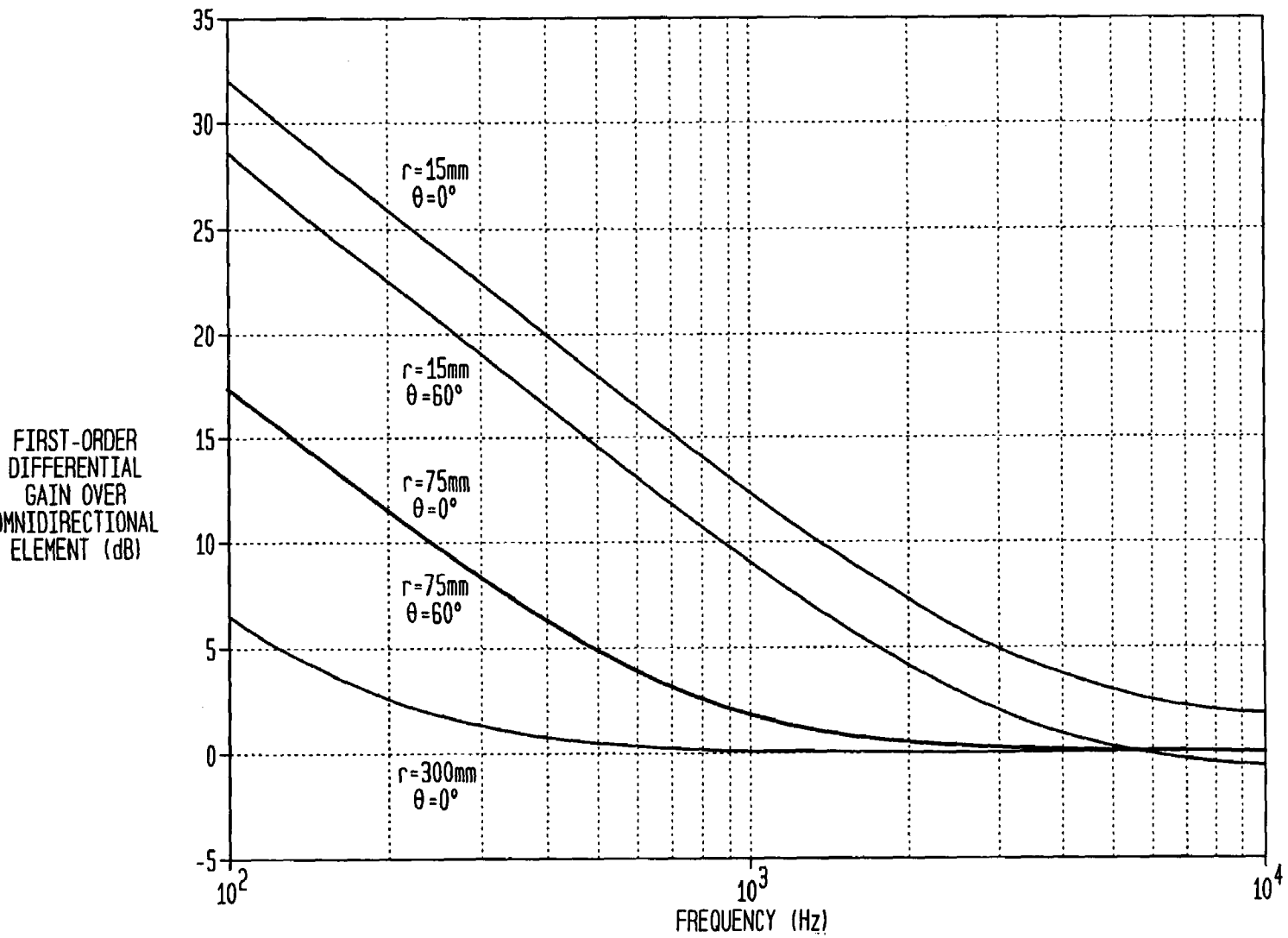
FIG. 6 shows a graphical representation of the gain of the first-order CTMA of FIG. 2 over an omnidirectional transducer for different distances and orientation angles.

FIG. 6 shows a graphical representation of the gain of the first-order CTMA of FIG. 2 over an omnidirectional transducer for different distances and orientation angles. FIG. 6 provides another way of illustrating the improvement gained by using a first-order CTMA over an omnidirectional element. Here, the preference for constraining the range of operation (r,θ) to values (e.g., 15 mm<r<75 mm, 0°<θ<60°) where reasonable gain can be obtained becomes apparent.

By taking the inverse of Equation (2), the desired frequency response equalization filter can be derived analytically. Transformation of this filter into the digital domain by means of the bilinear transform yields a second-order Infinite Impulse Response (IIR) filter that corrects for gain and frequency response deviation over the range of operation with reasonably good performance (see, e.g., FIGS. 4 and 5). This procedure is described in further detail later in this specification.

Parameter Estimation

In order to obtain the filter coefficients, an estimate of the current array position $(\hat{r},\hat{\theta})$ with respect to the talker's mouth is used. Two possible ways of generating such estimates are based on time delay of arrival (TDOA) and relative signal level between the microphones.

Due to the fact that the microphone array is used in a close-talking environment, room reverberation can be neglected and the ideal free-field model is used, which, in the case of the two microphones as depicted in FIG. 2, may be given by Equations (3) and (4) as follows:

$$X_1(f)=S(f)+N_1(f),$$

$$X_2(f)=\alpha S(f)e^{-j2\pi f\tau_{12}}+N_2(f), \tag{3)–(4}$$

where S(f) is the spectrum of the signal source, $X_1(f)$ and $X_2(f)$ are the spectra of the signals received by the respective microphones 202 and 204, $N_1(f)$ and $N_2(f)$ are the noise signals picked up by each microphone, $\tau_{12}$ is the time delay between the received microphone signals, and α is an attenuation factor. It is assumed that S(f), $N_1(f)$, and $N_2(f)$ represent zero-mean, uncorrelated Gaussian processes. TDOA $\tau_{12}$ can be obtained by looking at the phase φ(f) of the cross-correlation between $X_1(f)$ and $X_2(f)$, which is linear in the case of zeroth-order elements, where the phase φ(f) is given by Equation (5) as follows:

$$\phi(f)=\arg(E\{X_1(f)X_2^*(f)\})=2\pi f\tau_{12}+\epsilon, \tag{5}$$

where ε is the phase deviation added by the noise components that have zero mean, because of the assumptions underlying the acoustic model. As a consequence of the linear phase, the problem of finding the TDOA can be transformed into a linear regression problem that can be solved by using a maximum likelihood estimator and chi-square fitting (see Press, W. H., Teukolsky, S. A., Vetterling, W. T., and Flannery, B. P., "Numerical Recipes in C—The Art of Scientific Computing," Cambridge University Press, Cambridge, Mass., USA, second ed., 1992, the teachings of which are incorporated herein by reference). The result of this algorithm delivers an estimate for the TDOA $\hat{\tau}$.

Geometrically, as represented in FIG. 2, the TDOA can be formulated according to Equation (6) as follows:

$$\tau_{12}=\frac{r_2-r_1}{c}\overset{farfield}{\approx}\frac{d}{c}\cos\theta. \tag{6}$$

Simulations with the parameters used for this application have shown that the error introduced by using the farfield approximation applied to the nearfield case is not critical in this particular case (see results reproduced below in the section entitled "Simulations"). Therefore, the estimate $\hat{\theta}$ for the orientation angle can be written according to Equation (7) as follows:

$$\hat{\theta}=\arccos\frac{c\hat{\tau}}{d}. \tag{7}$$

The amplitude difference between signal 1 ($V_1(r,\theta;f)$) for microphone 202 and signal 2 ($V_2(r,\theta;f)$) for microphone 204 is $$a=\frac{V_1(r,\theta;f)}{V_2(r,\theta;f)}\approx\frac{r_2}{r_1}, \tag{8}$$

and it can be shown that the estimate $\hat{r}$ of the distance can be obtained using Equation (9) as follows:

$$\hat{r}=\frac{d}{2}\left[\frac{a^2+1}{a^2-1}\cos\hat{\theta}+\sqrt{\left(\frac{a^2+1}{a^2-1}\cos\hat{\theta}\right)^2-1}\right]. \tag{9}$$

Figure 7:
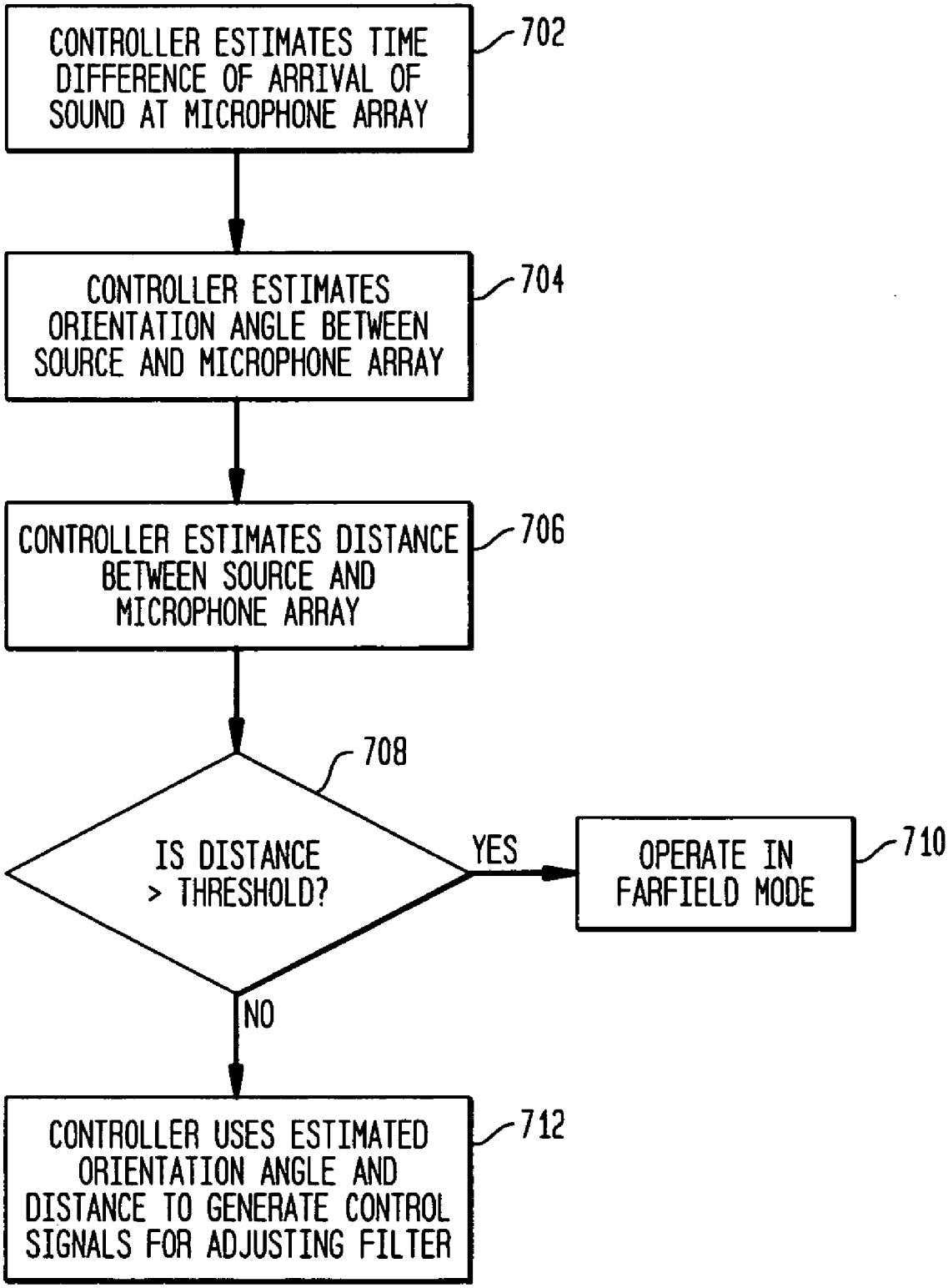
FIG. 7 shows a flow diagram of the audio processing of the system of FIG. 1, according to one embodiment of the present invention.

FIG. 7 shows a flow diagram of the audio processing of system 100 of FIG. 1, according to one embodiment of the present invention. In particular, in step 702, controller 108 estimates the TDOA τ for sound arriving at CTMA 102 from source S using Equation (5) based on the phase φ(f) of the cross-correlation between $X_1(f)$ and $X_2(f)$ and solving the linear regression problem using a maximum likelihood estimator and chi-square fitting. In step 704, controller 108 estimates the orientation angle θ between source S and axis 208 of CTMA 102 using Equation (7) based on the known microphone inter-element distance d and the estimated TDOA $\hat{\tau}$ from step 702. In step 706, controller 108 estimates the distance r between source S and CTMA 102 using Equation (9) based on the known distance d, the measured amplitude difference α, and the estimated orientation angle $\hat{\theta}$ from step 704.

FIG. 7 illustrates particular embodiments of audio processing system 100 of FIG. 1 that are capable of adaptively operating in either a nearfield mode of operation or a farfield mode of operation. In these embodiments, if the estimated distance $\hat{r}$ between the source S and the microphone array from step 706 is greater than a specified threshold value (step 708), then audio processing system 100 operates in its farfield mode of operation (step 710). Possible implementations of the farfield mode of operation are described in U.S. Pat. No. 5,473,701 (Cezanne et al.). Other possible farfield mode implementations are described in U.S. patent application Ser. No. 09/999,298, filed on the same date as the present application. The teachings of both of these references are incorporated herein by reference. In other possible embodiments of audio processing system 100, steps 708 and 710 are either optional or omitted entirely.

If the estimated distance is not greater than the threshold value (step 708) (or if step 708 is not implemented), then audio processing system 100 operates in its nearfield mode of operation. In particular, in step 712, controller 108 uses the estimated distance $\hat{r}$ from step 706 and the estimated orientation angle $\hat{\theta}$ from step 704 to generate control signals 116 used to adjust the frequency response of filter 106 of FIG. 1. The processing of step 712 is described in further detail in the following section.

Depending on the particular implementation, embodiments of audio processing system 100 of FIG. 1 that are capable of adaptively operating in either a nearfield or a farfield mode of operation, the determination of whether to operate in the nearfield or farfield mode (i.e., step 708) may be made once at the initiation of operations or multiple times (e.g., periodically) to enable adaptive switching between the nearfield and farfield modes. Furthermore, in some implementations of such audio processing systems, the nearfield mode of operation may be based on the teachings in U.S. Pat. No. 5,586,191 (Elko et al.), the teachings of which are incorporated herein by reference, or some other suitable nearfield mode of operation.

Adaptive Filtering for Nearfield Operations

Referring again to FIG. 1, for the nearfield mode of operation, signal 104 from microphone array 102 is filtered by filter 106 based on control signals 116 generated by controller 108. According to preferred embodiments of the present invention, those control signals are based on the estimates of orientation angle θ and distance r generated during steps 704 and 706 of FIG. 7, respectively. In particular, the control signals are generated to cause filter 106 to correct for gain and frequency response deviations in signal 104.

For a first-order differential microphone array, the frequency response equalization provided by filter 106 of FIG. 1 may be implemented as a second-order equalization filter whose transfer function is given by Equation (10) as follows:

$$H_{eq1}(z) = H_{mic}^{-1}(z)\cdot H_1(z) = \frac{b_0 + b_1 z^{-1} + b_2 z^{-2}}{a_0 + a_1 z^{-1} + a_2 z^{-2}}, \tag{10}$$

where $H_{mlc}^{-1}(z)$ is the inverse of the transfer function for the microphone array and $H_1(z)$ is the transfer function for the desired frequency response equalization. The coefficients in Equation (10) are given by Equations (11a–f) as follows:

$$a_0 = 1 + \frac{f_s}{\pi}\sqrt{\frac{2}{f_2^2} - \frac{1}{f_1^2}} + \frac{f_s^2}{f_2^2\pi^2}, \tag{11a}$$

$$a_1 = 2\left(1 - \frac{f_s^2}{f_2^2\pi^2}\right), \tag{11b}$$

$$a_2 = 1 - \frac{f_s}{\pi}\sqrt{\frac{2}{f_2^2} - \frac{1}{f_1^2}} + \frac{f_s^2}{f_2^2\pi^2}, \tag{11c}$$

$$b_0 = \frac{4}{1 + \alpha_1 + \alpha_2}, \tag{11d}$$

$$b_1 = \frac{4\alpha_1}{1 + \alpha_1 + \alpha_2}, \tag{11e}$$

$$b_2 = \frac{4\alpha_2}{1 + \alpha_1 + \alpha_2}, \tag{11f}$$

where $f_s$ is the sampling frequency (e.g., 22050 Hz) and:

$$f_1 = \frac{c}{2\pi}\sqrt{\frac{A_1}{B_1}}, \tag{12a}$$

$$f_2 = \frac{c}{2\pi}\sqrt{\frac{2A_1}{A_1 r^2 + B_1}}, \tag{12b}$$

$$A_1 = \frac{1}{r_1} - \frac{1}{r_2}, \tag{12c}$$

$$B_1 = r_1 - r_2, \tag{12d}$$

$$r_1 = \sqrt{r^2 - rd\cos\theta + d^2/4} \tag{12e}$$

$$r_2 = \sqrt{r^2 + rd\cos\theta + d^2/4} \tag{12f}$$

$$\alpha_1 = -\frac{2(1-\beta^2)}{1 + 2\beta\xi + \beta^2}, \tag{12g}$$

$$\alpha_2 = \frac{1 - 2\beta\xi + \beta^2}{1 + 2\beta\xi + \beta^2}, \tag{12h}$$

$$\beta = \tan\pi\frac{f_n}{f_s}, \tag{12i}$$

where c is the speed of sound, $r_1$ is the distance between source S and element 202 of FIG. 2, $r_2$ is the distance between source S and element 204, d is the inter-element distance in the first-order microphone array, ξ denotes the damping factor, and $f_n$ is the natural frequency. For an implementation using two omnidirectional microphones of the type Panasonic WM-54B, the frequency response of the elements suggests ξ=0.7 and $f_n$=15000 Hz.

In addition to the frequency response equalization of Equation (10), filter 106 of FIG. 1 also preferably performs gain equalization. In one implementation, such gain equalization is achieved by applying a gain factor that is proportional to $G_1$ in Equation (13) as follows:

$$G_1 = \frac{r_1 r_2}{r_2 - r_1}, \tag{13}$$

where $r_1$ and $r_2$ are given by Equations (12e) and (12f), respectively.

As is apparent from Equations (11a–f) and (12a–i), both the frequency response equalization function given in Equation (10) and the gain equalization function given in Equation (13) depend ultimately on only the orientation angle θ and the distance r between the microphone array and the sound source S, and, in particular, on the estimates $\hat{\theta}$ and $\hat{r}$ generated during steps 704 and 706 of FIG. 7, respectively.

In some implementations, the processing of filter 106 is adaptively adjusted only for significant changes in (r,θ). For example, in one implementation, the (r,θ) values are quantized and the filter coefficients are updated only when the changes in (r,θ) are sufficient to result in a different quantization state. In a preferred implementation, "adjacent" quantization states are selected to keep the quantization errors to within some specified level (e.g., 3 dB).

Simulations

Figure 8:
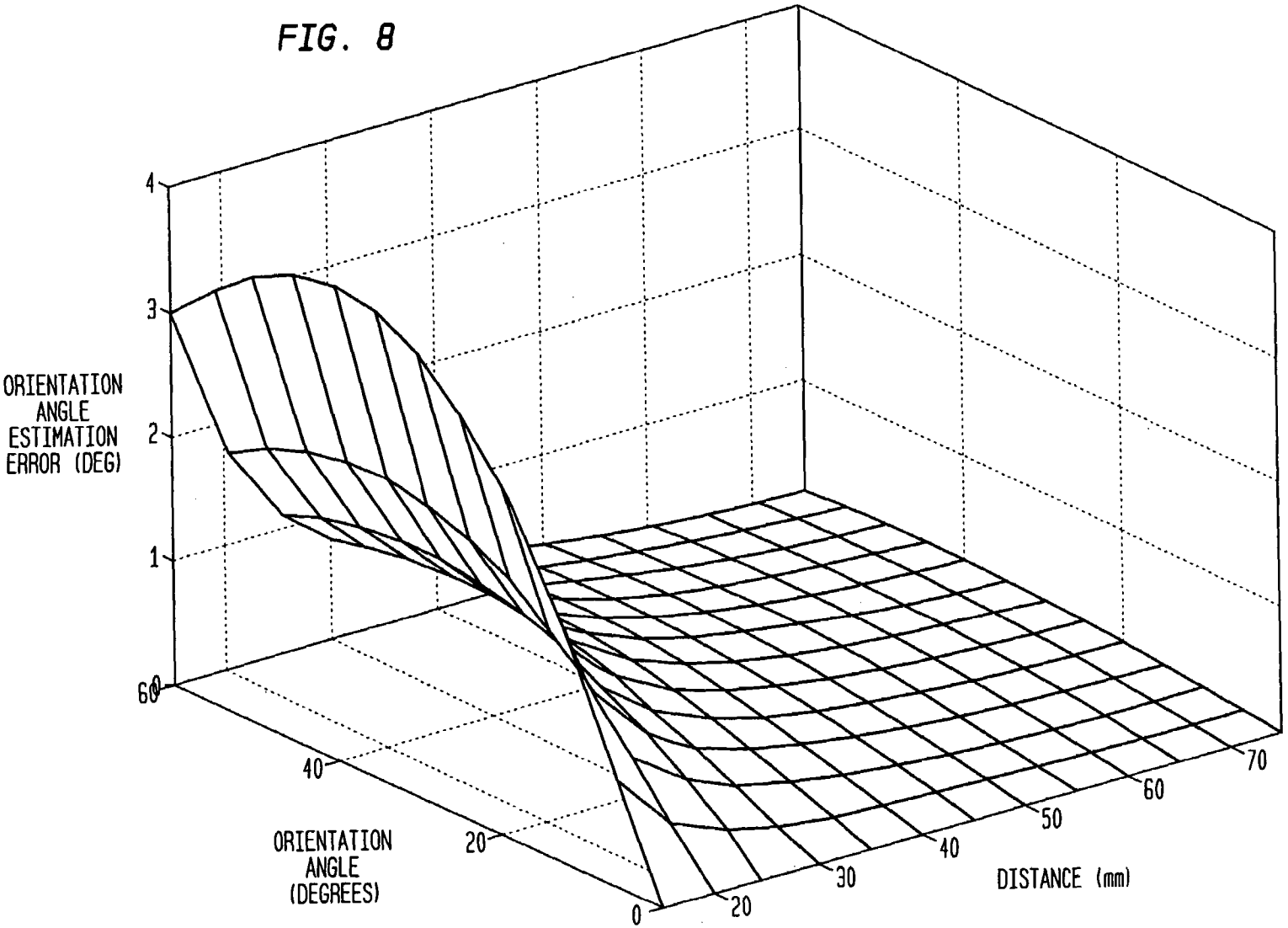
FIG. 8 shows a graphical representation of the simulated orientation angle estimation error for the first-order CTMA of FIG. 2.
Figure 9:
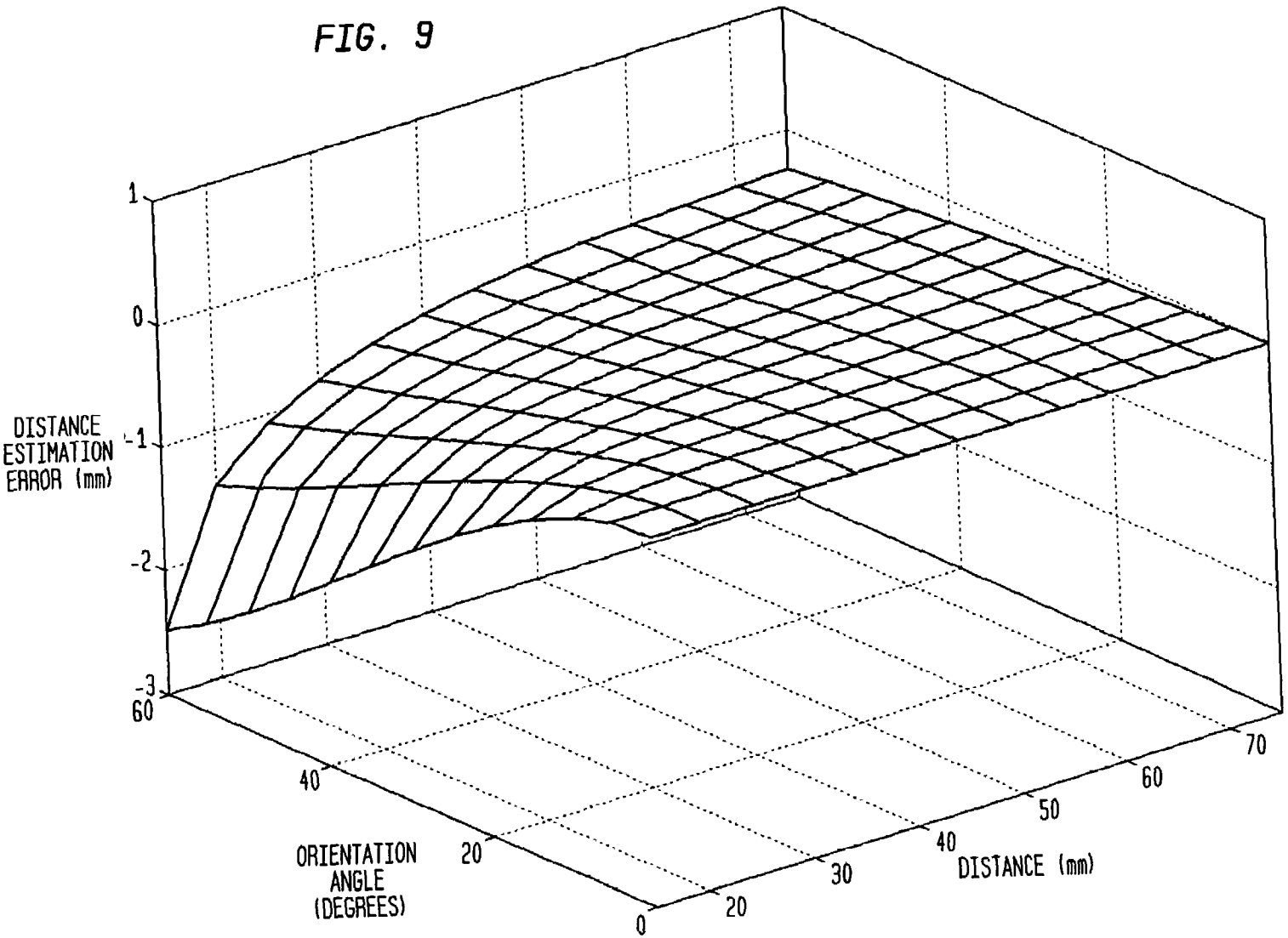
FIG. 9 shows a graphical representation of the simulated distance estimation error for the first-order CTMA of FIG. 2.

Simulations for the errors in the angle and distance estimation are reproduced in FIGS. 8 and 9, respectively, where the data represent the exact values minus the estimated ones. It can be seen that the estimation works very well except for situations where the signal source is located very close to the array's center (r<20 mm) and the orientation angle is fairly large (θ>40°). This result can be explained by the approximation used in Equation (6). Nevertheless, these simulations show encouraging results for the location estimation.

Influence of Transducer Element Sensitivity Mismatch on CTMA Performance

Figure 10:
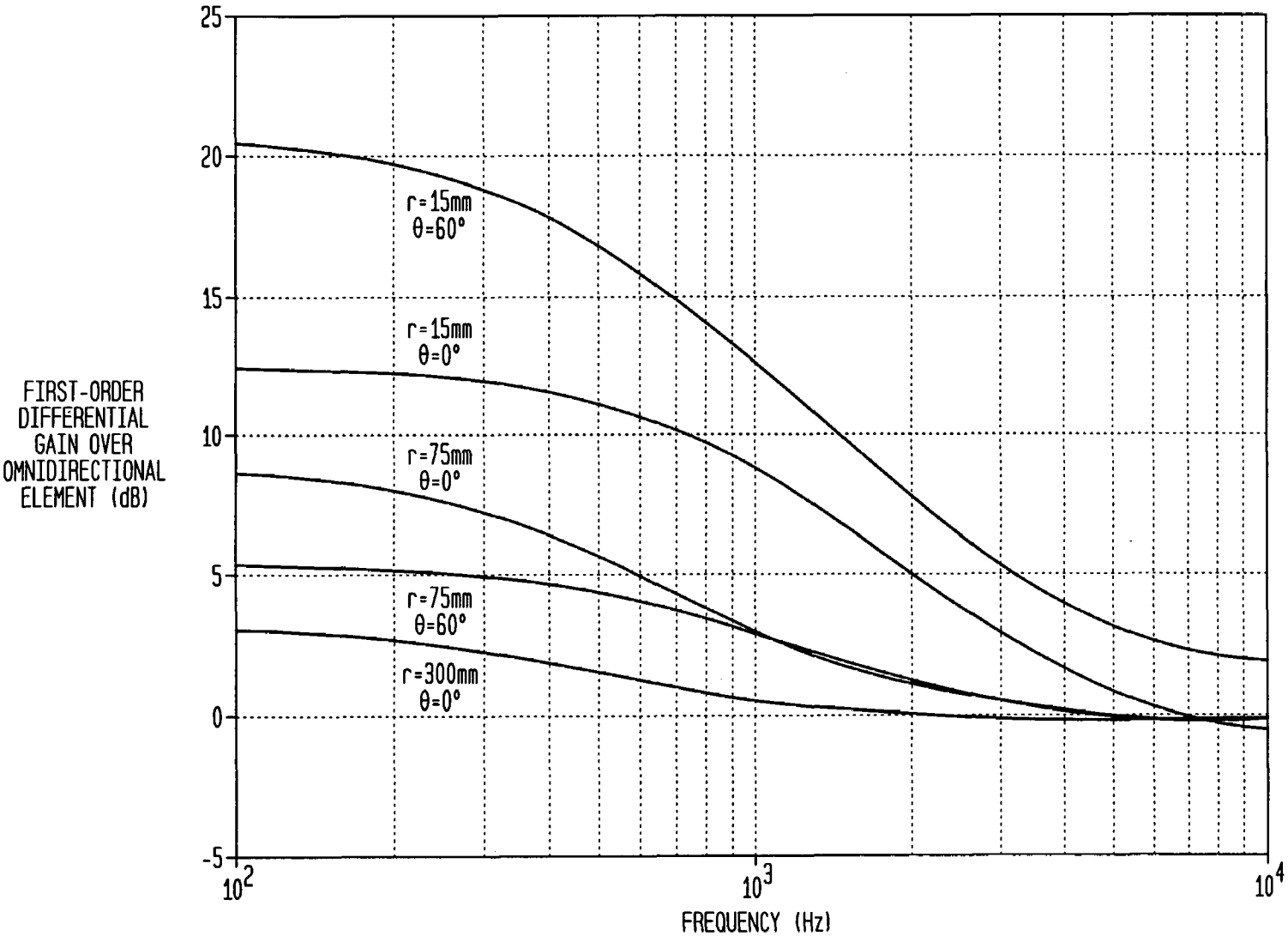
FIG. 10 shows a graphical representation of the gain of the first-order CTMA of FIG. 2 over an omnidirectional transducer with 1-dB transducer sensitivity mismatch.
Figure 11:
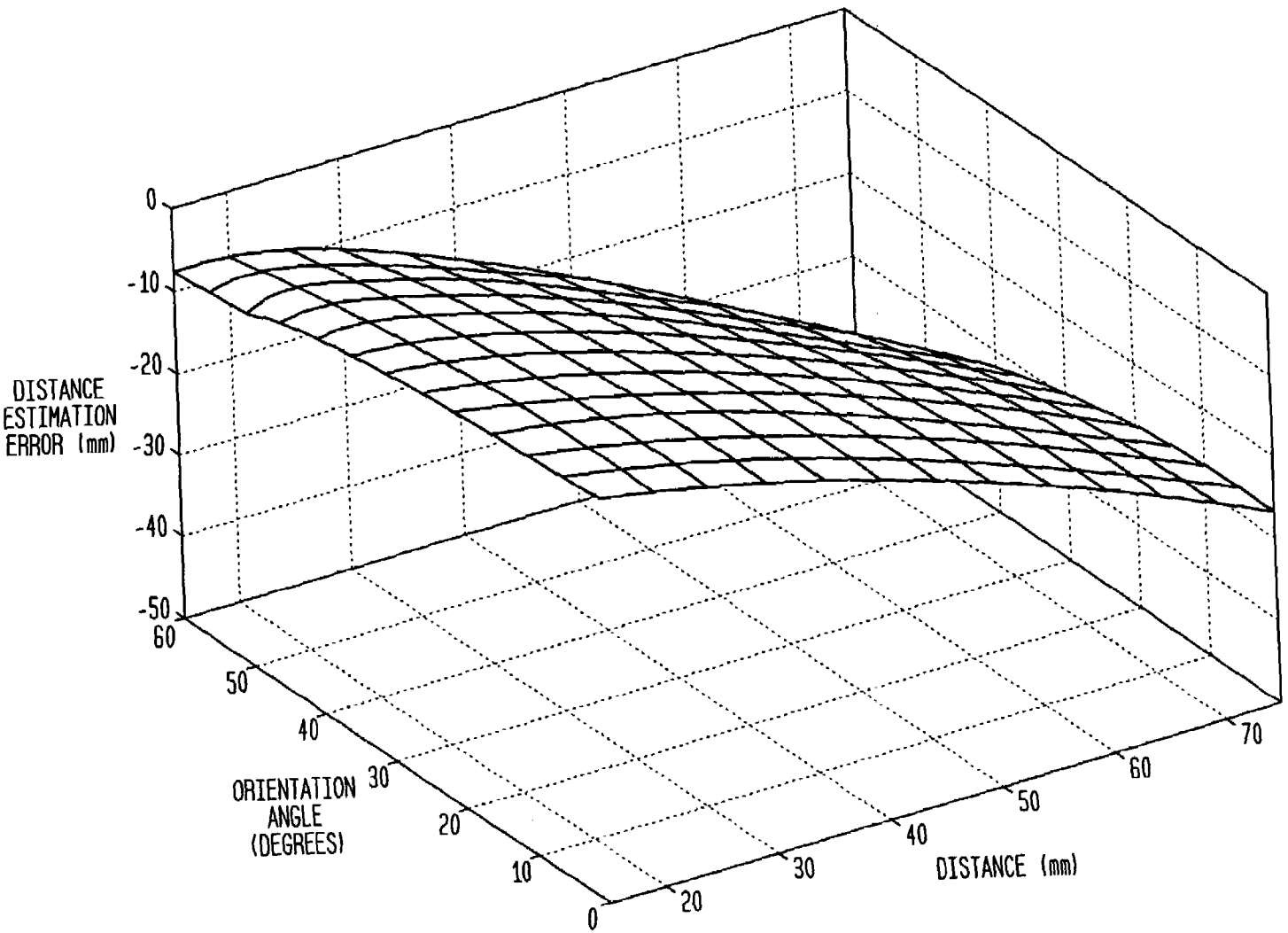
FIG. 11 shows a graphical representation of the simulated distance estimation error for the first-order CTMA of FIG. 2 with transducer sensitivity mismatch (1 dB)

The simulations shown in FIGS. 8 and 9 are valid for transducers that are matched perfectly. This, however, can never be expected in practice since there are always deviations regarding amplitude and phase responses between two transducer elements. To illustrate the impact that a mere 1-dB mismatch in amplitude response has on the performance of a first-order CTMA, the resulting achievable gain of a first-order CTMA over an omnidirectional element is shown in FIG. 10. Compared to the optimum case (see FIG. 6), the performance is now considerably worse. In addition, not only is the achievable gain subject to performance degradation but so is the distance estimation, which is shown in FIG. 11 for the new situation.

Because only frequency-independent microphone sensitivity difference is examined here, the orientation angle estimation error remains the same. Unfortunately, since frequency-independent microphone sensitivity difference cannot be assumed in practice, performance can degrade even more than in the simplified situation depicted in FIG. 11.

Microphone Calibration

The previous section stressed the fact that satisfactory performance of an first-order CTMA cannot necessarily be expected if the two transducers are not matched. The utilization of extremely expensive pairwise-matched transducers is not practical for mass-market use. Therefore, the following microphone calibration technique, which can be repeated whenever it becomes necessary, may be used in real-time implementations of the first-order CTMA.

1. A broadband signal (e.g., white noise) is positioned in the farfield at broadside with respect to the array.
2. A normalized least mean square (NLMS) algorithm with a 32-tap adaptive filter minimizes the mean squared error of the microphone signals.
3. If the power of the error signal falls below a preset value, the filter coefficients are frozen and this calibration filter is used to compensate for the sensitivity mismatch of the two elements.

Figure 12:
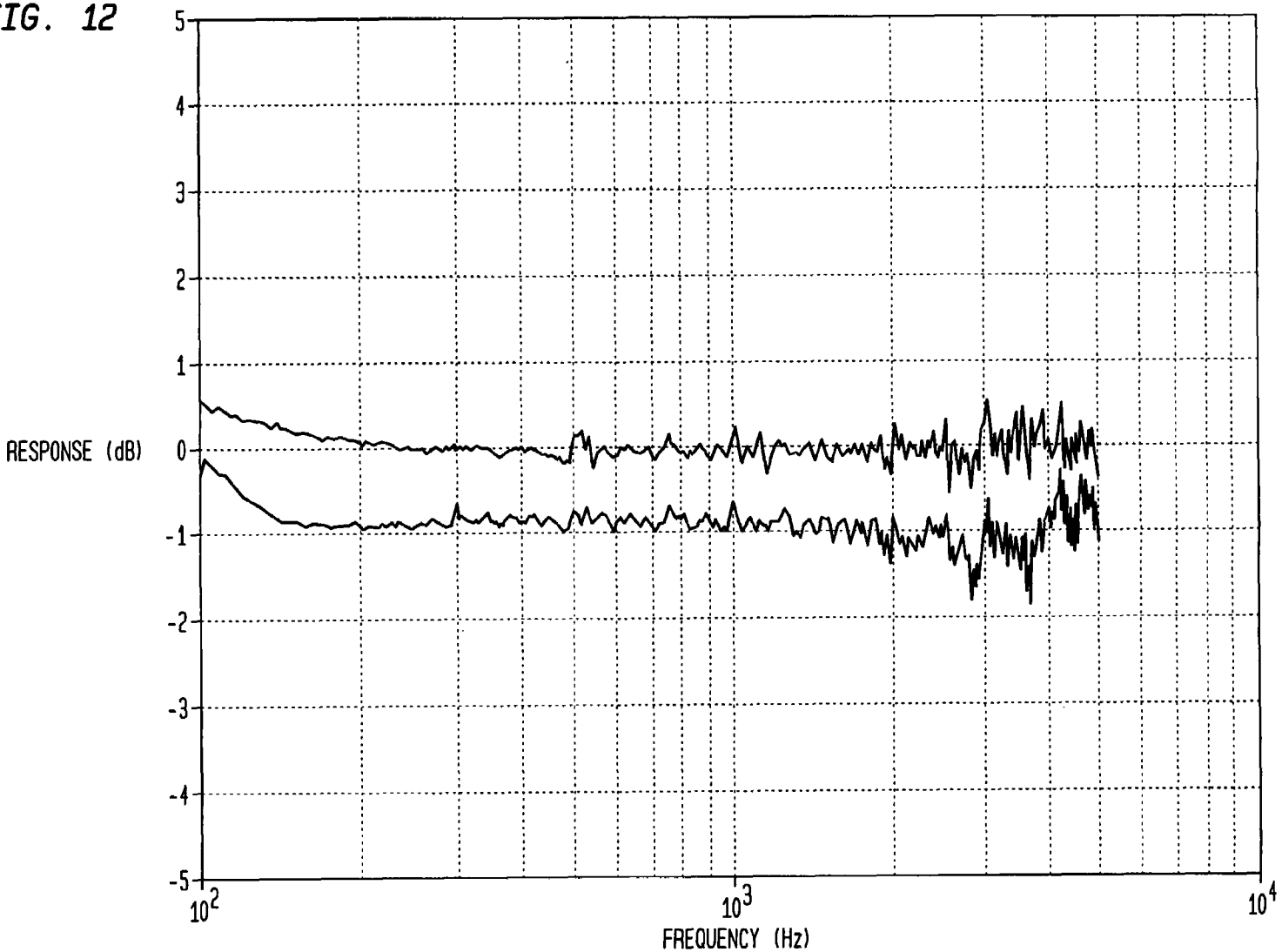
FIG. 12 shows a graphical representation of the measured uncalibrated (lower curve) and calibrated (upper curve) amplitude sensitivity differences between two omnidirectional microphones.

An example of the results of this calibration procedure is shown in FIG. 12. The frequency dependent sensitivity mismatch between two omnidirectional elements is about 1 dB (lower curve). After applying the calibration algorithm, this mismatch is greatly diminished (upper curve).

Measurements

A PC-based real-time implementation running under the Microsoft® Windows® operating system was realized using a standard soundcard as the analog-to-digital converter. Furthermore, two omnidirectional elements of the type Panasonic WM-54B and a 40-dB preamplifier were used.

Figure 13:
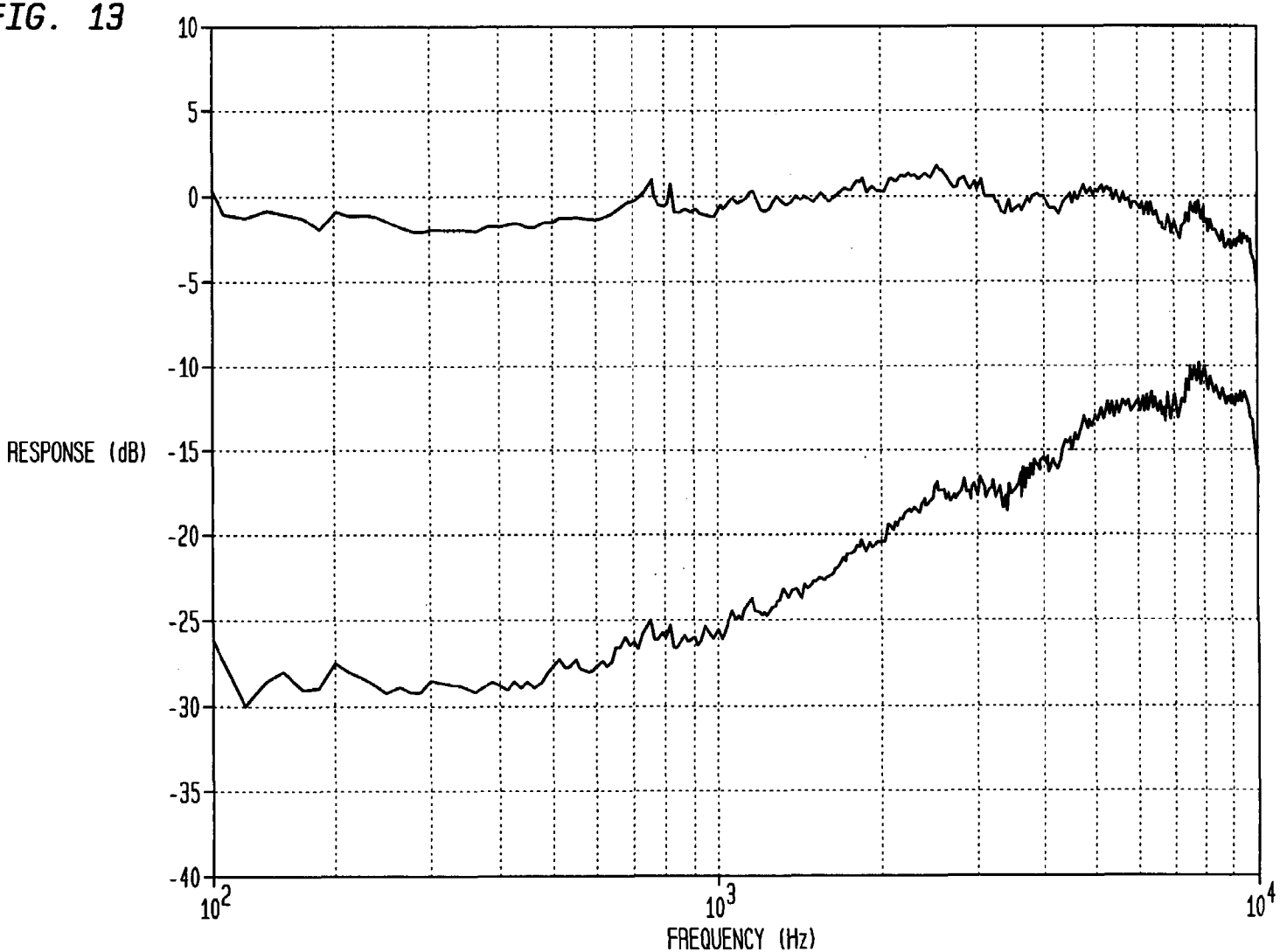
FIG. 13 shows a graphical representation of the measured uncorrected (lower curve) and corrected (upper curve) nearfield response of the first-order CTMA of FIG. 2 for d=1.5 cm, θ=20°, and r=75 mm.

Measurements were performed utilizing a Brüiel & Kjaer head simulator type 4128. FIG. 13 shows an exemplified nearfield frequency response without (lower curve) and with (upper curve) engagement of the frequency response correction filter (compare also with FIGS. 4 and 5), where the parameters (r,θ) were set manually.

Figure 14:
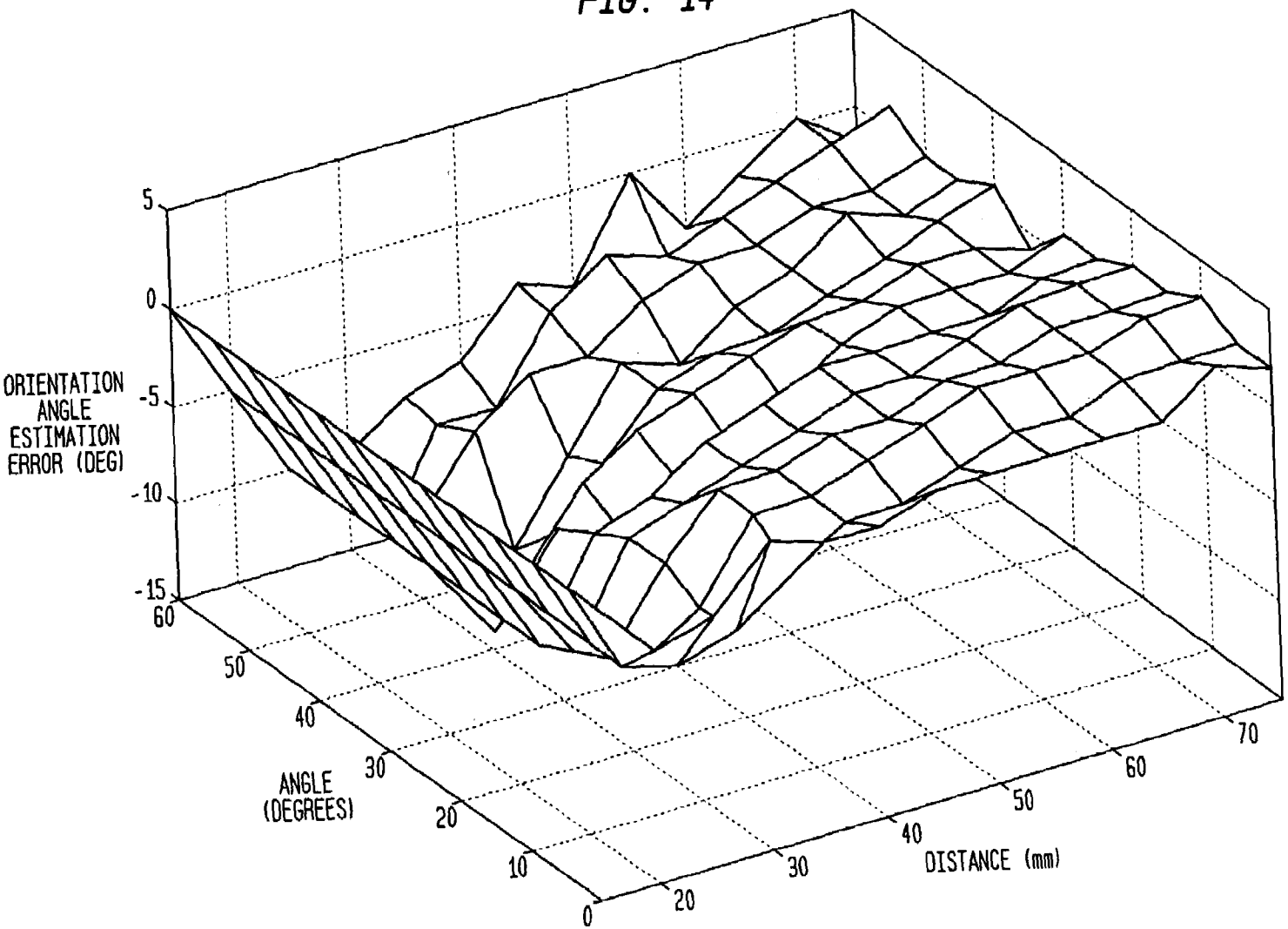
FIG. 14 shows a graphical representation of the measured orientation angle estimation error for the first-order CTMA of FIG. 2.
Figure 15:
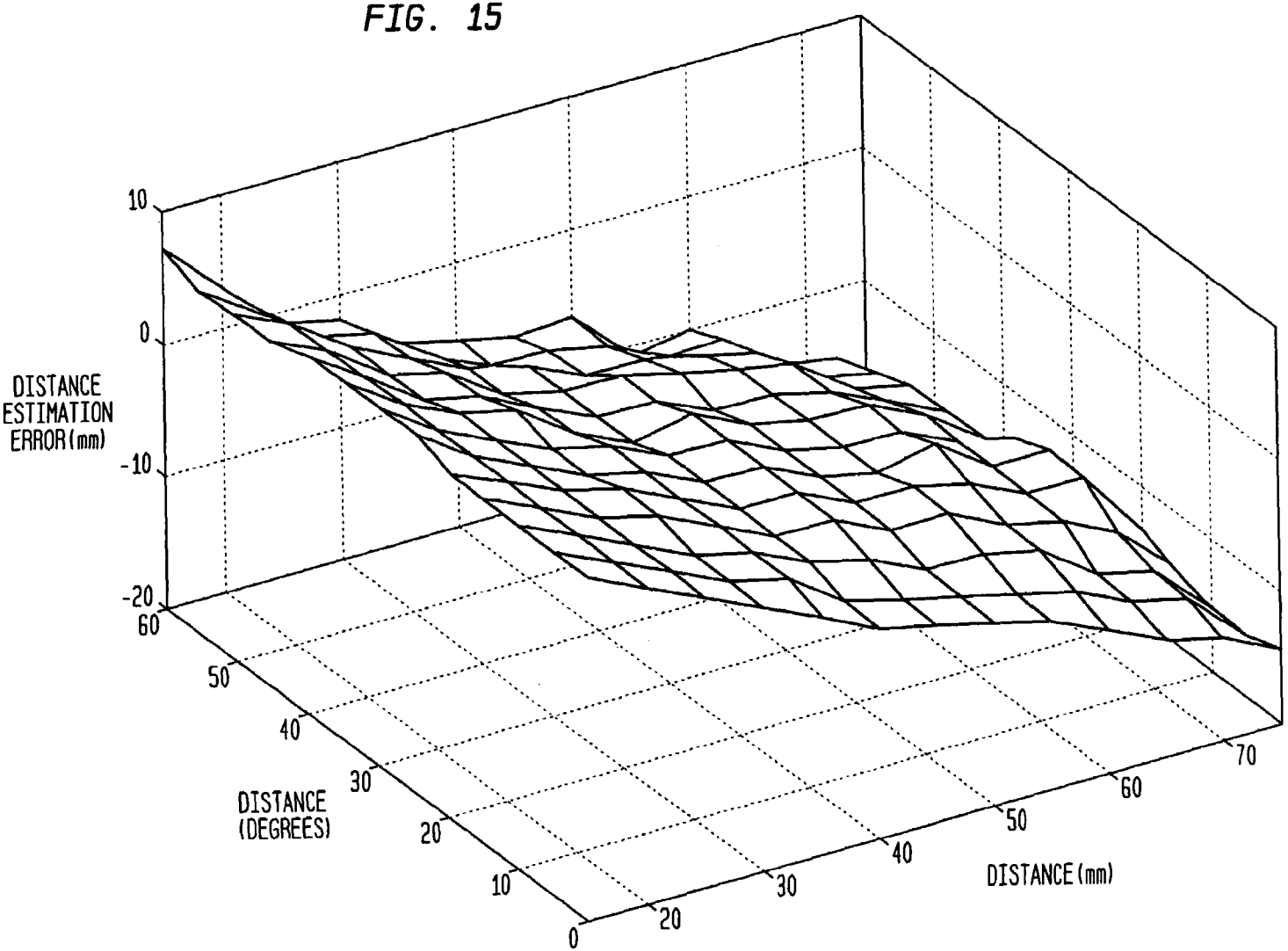
FIG. 15 shows a graphical representation of the measured distance estimation error for the first-order CTMA of FIG. 2.

Signal tracking capabilities of the array are very difficult to reproduce here, but the ability of finding a nearfield signal source can be shown by playing a stationary white noise signal through the artificial mouth, sampling this sound field with the array placed within its range of operation, and monitoring the error of the estimated values for distance $\hat{r}$ and angle $\hat{\theta}$ (see FIGS. 14 and 15).

By comparing the measured results of FIG. 12 with the simulated ones of FIGS. 8, 9, and 11, it can be said that the deviation can be accredited mainly to the fact that the microphones are not matched completely after calibration. Other reasons are microphone and preamplifier noise and the fact that a close-talking speaker cannot be modeled as a point source without error. However, simulations have shown that the model of a circular piston on a rigid spherical baffle, which is often used to describe a human talker in close-talking environments, can be replaced by the point source model in this application within the range of interest with reasonable accuracy.

The fact that the distance estimation gets worse for higher distances is not too critical in practice, since the amount of correction filters needed to obtain a perceptually constant frequency response decreases with increasing distance between signal source and CTMA.

CTMAs of Higher Order

A second-order CTMA consisting of two dipole elements, which naturally offers 12 dB/octave farfield low-frequency noise rejection, was also extensively studied. Two dipole elements were chosen since the demonstrator was meant to work with the same hardware setup (PC, stereo soundcard). It was found that the distance between the source and the CTMA can be determined and the frequency response deviations can be equalized quite accurately as long as θ=0°. The problem is that the phase of the cross-correlation is no longer linear and the linear curve-fitting technique can only approximate the actual phase. Better results can be expected if three omnidirectional elements are used instead of the two dipoles to form a second-order CTMA.

For even higher orders, it becomes less and less feasible to allow the axis of the array to be rotated with respect to the signal source, since a null in the CTMA's nearfield response moves closer and closer to $\theta=0°$.

CONCLUSIONS

A novel differential CTMA has been presented. It has been shown that a first-order nearfield adaptive CTMA comprising two omnidirectional elements delivers promising results in terms of being able to find and track a desired signal source in the nearfield (talker) within a certain range of operation and to correct for the dependency of the response on its position relative to the signal source. This correction is done without significantly degrading the noise-canceling properties inherent in first-order differential microphones.

For additional robustness against noise and other non-speech sounds, a subband speech activity detector, as described in Diethom, E. J., "A subband noise-reduction method for enhancing speech in telephony & teleconferencing," IEEE Workshop on Applications of Signal Processing to Audio and Acoustics (WASPAA), New Paltz, USA, 1997, the teachings of which are incorporated herein by reference, was employed which greatly improved the performance of the first-order CTMA in real acoustic environments.

The present invention may be implemented as circuit-based processes, including possible implementation on a single integrated circuit. As would be apparent to one skilled in the art, various functions of circuit elements may also be implemented as processing steps in a software program. Such software may be employed in, for example, a digital signal processor, micro-controller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. A method for providing a differential microphone with a desired frequency response, the differential microphone comprising first and second microphone elements and coupled to a filter having a frequency response which is adjustable, the method comprising the steps of:

(a) determining an orientation angle between the differential microphone and a desired source of signal;

(b) determining an amplitude difference between the first and second microphone elements;

(c) determining a distance between the differential microphone and the desired source of signal based on the determined orientation angle and the determined amplitude difference;

(d) determining a filter frequency response, based on the determined distance and orientation angle, to provide the differential microphone with the desired frequency response to sound from the desired source; and (e) adjusting the filter to exhibit the determined frequency response.

2. The invention of claim 1, wherein the differential microphone is a close-talking differential microphone array (CTMA).

3. The invention of claim 2, wherein the CTMA is a first-order microphone array.

4. The invention of claim 1, wherein step (a) comprises the steps of:

(1) determining a time difference of arrival (TDOA) of sound from the desired source for the differential microphone; and (2) determining the orientation angle based on the TDOA.

5. The invention of claim 1, further comprising the step of performing a calibration procedure to compensate for differences between elements in the differential microphone.

6. The invention of claim 5, wherein the calibration procedure comprises the steps of:

(1) minimizing mean squared error of differential microphone signals corresponding to a farfield broadband audio source positioned at broadside with respect to the differential microphone;

(2) selecting coefficients for a calibration filter when power of the minimized mean squared error falls below a specified threshold level; and (3) filtering the differential microphone signals using the calibration filter to compensate for the differences between the elements in the differential microphone.

7. The invention of claim 1, wherein steps (d) and (e) are implemented only after determining that the determined distance is not greater than a specified threshold distance.

8. The invention of claim 7, wherein the differential microphone is operated in a farfield mode of operation after determining that the determined distance is greater than the specified threshold distance.

9. The invention of claim 1, further comprising the step of adjusting gain of the differential microphone.

10. The invention of claim 9, wherein adjustments to the gain are based on the determined orientation angle and the determined distance.

11. The invention of claim 1, wherein the determined angle and the determined distance are quantized to form a set of quantized parameters, wherein the filter is adjusted only when the set of quantized parameters changes.

12. The invention of claim 1, wherein:

the differential microphone is a first-order close-talking differential microphone array (CTMA);

step (a) comprises the steps of:

(1) determining a time difference of arrival (TDOA) of sound from the desired source for the differential microphone; and (2) determining the orientation angle based on the TDOA;

further comprising the step of performing a calibration procedure to compensate for differences between elements in the differential microphone;

the calibration procedure comprises the steps of:

(1) minimizing mean squared error of differential microphone signals corresponding to a farfield broadband audio source positioned at broadside with respect to the differential microphone;

(2) selecting coefficients for a calibration filter when power of the minimized mean squared error falls below a specified threshold level; and (3) filtering the differential microphone signals using the calibration filter to compensate for the differences between the elements in the differential microphone;

steps (d) and (e) are implemented only after determining that the determined distance is not greater than a specified threshold distance;

the differential microphone is operated in a farfield mode of operation after determining that the determined distance is greater than the specified threshold distance;

further comprising the step of adjusting gain of the differential microphone, wherein adjustments to the gain are based on the determined orientation angle and the determined distance; and the determined angle and the determined distance are quantized to form a set of quantized parameters, wherein the filter is adjusted only when the set of quantized parameters changes.

13. An apparatus for providing a differential microphone with a desired frequency response, the differential microphone comprising first and second microphone elements, the apparatus comprising:

(a) an adjustable filter, coupled to the differential microphone; and (b) a controller, coupled to the differential microphone and the filter and configured to:

(1) determine an orientation angle between the differential microphone and a desired source of sound;

(2) determine an amplitude difference between the first and second microphone elements;

(3) determine a distance between the differential microphone and the desired source of signal based on the determined orientation angle and the determined amplitude difference;

(4) determine a filter frequency response, based on the determined distance and orientation angle, to provide the differential microphone with the desired frequency response to sound from the desired source; and (5) adjust the filter to provide the differential microphone with the desired frequency response based on the determined distance and orientation angle.

14. The invention of claim 13, wherein the differential microphone is a close-talking differential microphone array (CTMA).

15. The invention of claim 14, wherein the CTMA is a first-order microphone array.

16. The invention of claim 13, wherein the controller is configured to:

(1) determine a time difference of arrival (TDOA) of sound from the desired source for the differential microphone; and (2) determine the orientation angle based on the TDOA.

17. The invention of claim 13, wherein the controller is configured to perform a calibration procedure to compensate for differences between elements in the differential microphone.

18. The invention of claim 17, wherein the calibration procedure comprises the steps of:

(1) minimizing mean squared error of differential microphone signals corresponding to a farfield broadband audio source positioned at broadside with respect to the differential microphone;

(2) selecting coefficients for a calibration filter when power of the minimized mean squared error falls below a specified threshold level; and (3) filtering the differential microphone signals using the calibration filter to compensate for the differences between the elements in the differential microphone.

19. The invention of claim 13, wherein the controller adjusts the filter only after determining that the determined distance is not greater than a specified threshold distance.

20. The invention of claim 19, wherein the differential microphone is operated in a farfield mode of operation after determining that the determined distance is greater than the specified threshold distance.

21. The invention of claim 13, wherein the controller adjusts gain of the differential microphone.

22. The invention of claim 21, wherein adjustments to the gain are based on the determined orientation angle and the determined distance.

23. The invention of claim 13, wherein the determined angle and the determined distance are quantized to form a set of quantized parameters, wherein the filter is adjusted only when the set of quantized parameters changes.

24. The invention of claim 13, wherein:

the differential microphone is a first-order close-talking differential microphone array (CTMA);

the controller is configured to:

(1) determine a time difference of arrival (TDOA) of sound from the desired source for the differential microphone; and (2) determine the orientation angle based on the TDOA;

the controller is configured to perform a calibration procedure to compensate for differences between elements in the differential microphone;

the calibration procedure comprises the steps of:

(1) minimizing mean squared error of differential microphone signals corresponding to a farfield broadband audio source positioned at broadside with respect to the differential microphone;

(2) selecting coefficients for a calibration filter when power of the minimized mean squared error falls below a specified threshold level; and (3) filtering the differential microphone signals using the calibration filter to compensate for the differences between the elements in the differential microphone;

the controller adjusts the filter only after determining that the determined distance is not greater than a specified threshold distance;

the differential microphone is operated in a farfield mode of operation after determining that the determined distance is greater than the specified threshold distance;

the controller adjusts gain of the differential microphone, wherein adjustments to the gain are based on the determined orientation angle and the determined distance; and the determined angle and the determined distance are quantized to form a set of quantized parameters, wherein the filter is adjusted only when the set of quantized parameters changes.

25. A machine-readable medium, having encoded thereon program code, wherein, when the program code is executed by a machine, the machine implements a method for providing a differential microphone with a desired frequency response, the differential microphone comprising first and second microphone elements and coupled to a filter having a frequency response which is adjustable, the method comprising the steps of:

(a) determining an orientation angle between the differential microphone and a desired source of signal;

(b) determining an amplitude difference between the first and second microphone elements;

(c) determining a distance between the differential microphone and the desired source of signal based on the determined orientation angle and the determined amplitude difference;

(d) determining a filter frequency response, based on the determined distance and orientation angle, to provide the differential microphone with the desired frequency response to sound from the desired source; and (e) adjusting the filter to exhibit the determined frequency response.

26. A method for providing a differential microphone with a desired frequency response, the differential microphone coupled to a filter having a frequency response which is adjustable, the method comprising the steps of:

(a) determining an orientation angle between the differential microphone and a desired source of signal;

(b) determining a distance between the differential microphone and the desired source of signal;

(c) determining a filter frequency response, based on the determined distance and orientation angle, to provide the differential microphone with the desired frequency response to sound from the desired source;

(d) adjusting the filter to exhibit the determined frequency response; and (e) performing a calibration procedure to compensate for differences between elements in the differential microphone, wherein the calibration procedure comprises the steps of:

(1) minimizing mean squared error of differential microphone signals corresponding to a farfield broadband audio source positioned at broadside with respect to the differential microphone;

(2) selecting coefficients for a calibration filter when power of the minimized mean squared error falls below a specified threshold level; and (3) filtering the differential microphone signals using the calibration filter to compensate for the differences between the elements in the differential microphone.

27. The invention of claim 26, wherein the differential microphone is a first-order close-talking differential microphone array (CTMA).

28. The invention of claim 26, wherein step (a) comprises the steps of:

(1) determining a time difference of arrival (TDOA) of sound from the desired source for the differential microphone; and (2) determining the orientation angle based on the TDOA.

29. The invention of claim 26, wherein the distance is determined based on the determined orientation angle.

30. The invention of claim 26, wherein:

steps (c) and (d) are implemented only after determining that the determined distance is not greater than a specified threshold distance; and the differential microphone is operated in a farfield mode of operation after determining that the determined distance is greater than the specified threshold distance.

31. The invention of claim 26, further comprising the step of adjusting gain of the differential microphone based on the determined orientation angle and the determined distance.

32. The invention of claim 26, wherein the determined angle and the determined distance are quantized to form a set of quantized parameters, wherein the filter is adjusted only when the set of quantized parameters changes.

33. The invention of claim 26, wherein:

the differential microphone is a first-order close-talking differential microphone array (CTMA);

step (a) comprises the steps of:

(1) determining a time difference of arrival (TDOA) of sound from the desired source for the differential microphone; and (2) determining the orientation angle based on the TDOA;

the distance is determined based on the determined orientation angle;

steps (c) and (d) are implemented only after determining that the determined distance is not greater than a specified threshold distance;

the differential microphone is operated in a farfield mode of operation after determining that the determined distance is greater than the specified threshold distance;

further comprising the step of adjusting gain of the differential microphone, wherein adjustments to the gain are based on the determined orientation angle and the determined distance; and the determined angle and the determined distance are quantized to form a set of quantized parameters, wherein the filter is adjusted only when the set of quantized parameters changes.

34. An apparatus for providing a differential microphone with a desired frequency response, the apparatus comprising:

(a) an adjustable filter, coupled to the differential microphone; and (b) a controller, coupled to the differential microphone and the filter and configured to (1) determine a distance and an orientation angle between the differential microphone and a desired source of sound and (2) adjust the filter to provide the differential microphone with the desired frequency response based on the determined distance and orientation angle, wherein:

the controller is configured to perform a calibration procedure to compensate for differences between elements in the differential microphone; and the calibration procedure comprises the steps of:

(1) minimizing mean squared error of differential microphone signals corresponding to a farfield broadband audio source positioned at broadside with respect to the differential microphone;

(2) selecting coefficients for a calibration filter when power of the minimized mean squared error falls below a specified threshold level; and (3) filtering the differential microphone signals using the calibration filter to compensate for the differences between the elements in the differential microphone.

35. The invention of claim 34, wherein the differential microphone is a first-order close-talking differential microphone array (CTMA).

36. The invention of claim 34, wherein the controller is configured to:

(1) determine a time difference of arrival (TDOA) of sound from the desired source for the differential microphone; and (2) determine the orientation angle based on the TDOA.

37. The invention of claim 34, wherein the distance is determined based on the determined orientation angle.

38. The invention of claim 34, wherein:

the controller adjusts the filter only after determining that the determined distance is not greater than a specified threshold distance; and the differential microphone is operated in a farfield mode of operation after determining that the determined distance is greater than the specified threshold distance.

39. The invention of claim 34, wherein the controller adjusts gain of the differential microphone based on the determined orientation angle and the determined distance.

40. The invention of claim 34, wherein the determined angle and the determined distance are quantized to form a set of quantized parameters, wherein the filter is adjusted only when the set of quantized parameters changes.

41. The invention of claim 34, wherein:

the differential microphone is a first-order close-talking differential microphone array (CTMA);

the controller is configured to:

(1) determine a time difference of arrival (TDOA) of sound from the desired source for the differential microphone; and (2) determine the orientation angle based on the TDOA;

the distance is determined based on the determined orientation angle;

the controller is configured to perform a calibration procedure to compensate for differences between elements in the differential microphone;

the calibration procedure comprises the steps of:

(1) minimizing mean squared error of differential microphone signals corresponding to a farfield broadband audio source positioned at broadside with respect to the differential microphone;

(2) selecting coefficients for a calibration filter when power of the minimized mean squared error falls below a specified threshold level; and (3) filtering the differential microphone signals using the calibration filter to compensate for the differences between the elements in the differential microphone;

the controller adjusts the filter only after determining that the determined distance is not greater than a specified threshold distance;

the differential microphone is operated in a farfield mode of operation after determining that the determined distance is greater than the specified threshold distance;

the controller adjusts gain of the differential microphone, wherein adjustments to the gain are based on the determined orientation angle and the determined distance; and the determined angle and the determined distance are quantized to form a set of quantized parameters, wherein the filter is adjusted only when the set of quantized parameters changes.

42. A machine-readable medium, having encoded thereon program code, wherein, when the program code is executed by a machine, the machine implements a method for providing a differential microphone with a desired frequency response, the differential microphone coupled to a filter having a frequency response which is adjustable, the method comprising the steps of:

(a) determining an orientation angle between the differential microphone and a desired source of signal;

(b) determining a distance between the differential microphone and the desired source of signal;

(c) determining a filter frequency response, based on the determined distance and orientation angle, to provide the differential microphone with the desired frequency response to sound from the desired source;

(d) adjusting the filter to exhibit the determined frequency response; and (e) performing a calibration procedure to compensate for differences between elements in the differential microphone, wherein the calibration procedure comprises the steps of:

(1) minimizing mean squared error of differential microphone signals corresponding to a farfield broadband audio source positioned at broadside with respect to the differential microphone;

(2) selecting coefficients for a calibration filter when power of the minimized mean squared error falls below a specified threshold level; and (3) filtering the differential microphone signals using the calibration filter to compensate for the differences between the elements in the differential microphone.

* * * * *